US012157548B2

(12) United States Patent
Okaya et al.

(10) Patent No.: US 12,157,548 B2
(45) Date of Patent: Dec. 3, 2024

(54) UNDERWATER DOCKING SYSTEM, UNDERWATER VEHICLE, AND UNDERWATER STATION

(71) Applicant: KAWASAKI JUKOGYO KABUSHIKI KAISHA, Kobe (JP)

(72) Inventors: Noriyuki Okaya, Kobe (JP); Kosuke Masuda, Kobe (JP); Takashi Okada, Kobe (JP); Shinichi Miyata, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 419 days.

(21) Appl. No.: 17/835,664

(22) Filed: Jun. 8, 2022

(65) Prior Publication Data

US 2022/0297809 A1 Sep. 22, 2022

Related U.S. Application Data

(63) Continuation of application No. PCT/JP2019/051580, filed on Dec. 27, 2019.

(51) Int. Cl.
*B63G 8/00* (2006.01)
*B63G 8/38* (2006.01)

(52) U.S. Cl.
CPC ..... *B63G 8/38* (2013.01); *B63G 2008/008* (2013.01)

(58) Field of Classification Search
CPC .... B63G 8/38; B63G 2008/008; B63G 8/001; B63G 8/00; B63C 11/12; B63C 11/00
See application file for complete search history.

(56) References Cited

U.S. PATENT DOCUMENTS

| | | | | |
|---|---|---|---|---|
| 6,390,012 | B1 * | 5/2002 | Watt | B63B 27/36 114/51 |
| 10,410,788 | B1 * | 9/2019 | Bana | H02J 50/00 |
| 2018/0080307 | A1 * | 3/2018 | Outa | F16L 1/26 |
| 2018/0162503 | A1 * | 6/2018 | Reid | B63G 8/00 |
| 2019/0121370 | A1 * | 4/2019 | Sakaue | B63G 8/001 |
| 2022/0055494 | A1 * | 2/2022 | Gyland | H02J 50/90 |

FOREIGN PATENT DOCUMENTS

JP 2000-272583 A 10/2000

* cited by examiner

*Primary Examiner* — Andrew Polay
(74) *Attorney, Agent, or Firm* — Oliff PLC

(57) ABSTRACT

An underwater docking system according to one aspect of the present disclosure includes: an underwater vehicle that sails in water; and an underwater station with which the underwater vehicle docks. One of the underwater vehicle and the underwater station includes: a reference point; and a first fitting located around the reference point as a center. The other of the underwater vehicle and the underwater station includes: a detector that detects the reference point; and a second fitting located around the detector as a center and fitted to the first fitting. One of the first fitting and the second fitting is an annular groove. The other of the first fitting and the second fitting includes at least two protrusions that are inserted into the annular groove.

12 Claims, 7 Drawing Sheets

UNDERWATER DOCKING SYSTEM, UNDERWATER VEHICLE, AND UNDERWATER STATION

CROSS-REFERENCE TO RELATED APPLICATIONS

The present application is a bypass continuation of PCT Filing PCT/JP2019/051580, filed Dec. 27, 2019, which is incorporated by reference in its entirety.

BACKGROUND OF THE INVENTION

1. Field of the Invention

The present disclosure relates to an underwater docking system, an underwater vehicle, and an underwater station.

2. Description of the Related Art

An underwater vehicle, such as a remotely operated vehicle (ROV) or an autonomous underwater vehicle (AUV), which performs work in water docks with an underwater station when the underwater vehicle is charged, exchanges data, or the like. For example, according to an underwater docking system described in Japanese Laid-Open Patent Application Publication No. 2000-272583, an underwater vehicle approaches an underwater station from a predetermined direction and docks with the underwater station.

SUMMARY OF THE INVENTION

An underwater docking system according to one aspect of the present disclosure includes: an underwater vehicle that sails in water; and an underwater station with which the underwater vehicle docks. One of the underwater vehicle and the underwater station includes: a reference point; and a first fitting located around the reference point as a center. The other of the underwater vehicle and the underwater station includes: a detector that detects the reference point; and a second fitting located around the detector as a center and fitted to the first fitting. One of the first fitting and the second fitting is an annular groove. The other of the first fitting and the second fitting includes at least two protrusions that are inserted into the annular groove.

DESCRIPTION OF THE PREFERRED EMBODIMENTS

Embodiment 1

First, an underwater docking system 100 according to Embodiment 1 will be described. The underwater docking system 100 according to the present embodiment includes an underwater station 10 (see FIG. 1 and FIG. 2) and an underwater vehicle 30 (see FIG. 3 and FIG. 4). Hereinafter, the underwater station 10 and the underwater vehicle 30 will be described in order.

Underwater Station

Figure 1:
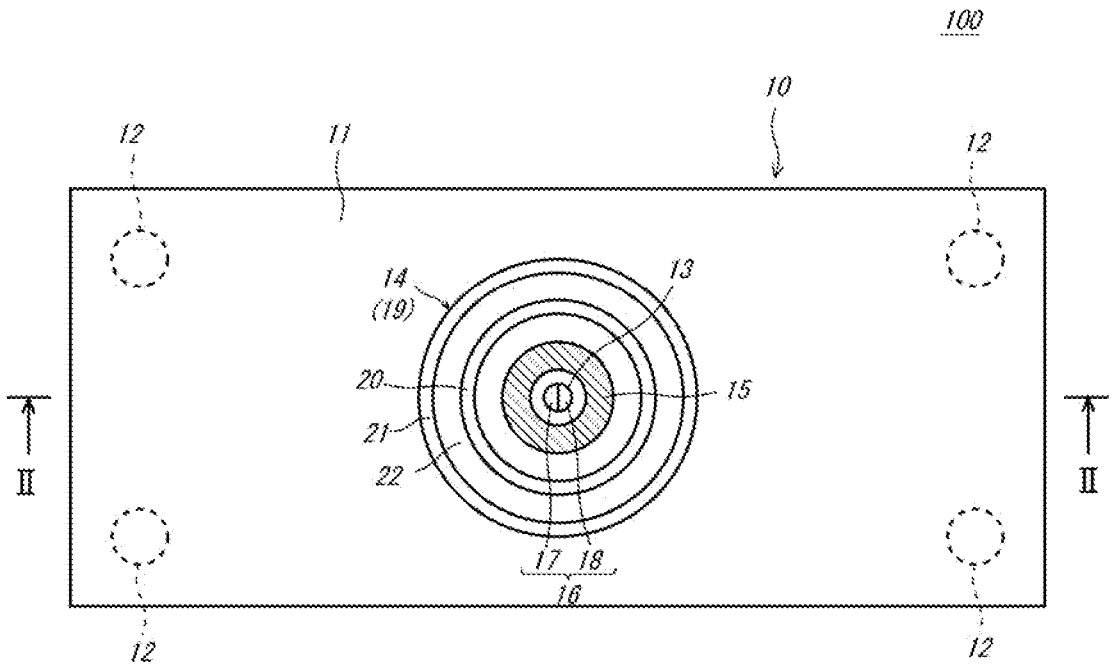
FIG. 1 is a plan view of an underwater station.
Figure 2:
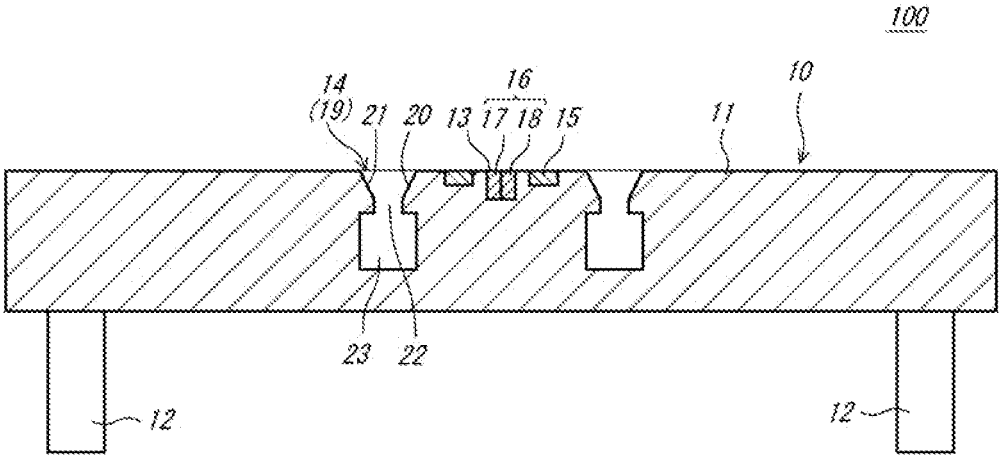
FIG. 2 is a sectional view taken along line II-II of FIG. 1.

The underwater station 10 is a facility with which the underwater vehicle 30 docks in order that the underwater vehicle 30 is charged and exchanges data. FIG. 1 is a plan view of the underwater station 10, and FIG. 2 is a sectional view taken along line II-II of FIG. 1. The underwater station 10 of the present embodiment is arranged at a water bottom. However, the position at which the underwater station 10 is arranged is not limited to this. For example, the underwater station 10 may be arranged near a water surface by being fixed to or coupled to a surface ship.

As shown in FIG. 1 and FIG. 2, the underwater station 10 includes a plate-shaped base 11 and legs 12 supporting the base 11. The underwater vehicle 30 of the present embodiment approaches the underwater station 10 from an upper side of the base 11 and docks with the underwater station 10. Moreover, as shown in FIG. 1, the underwater station 10 includes a reference point 13, a first fitting 14, and a power supply pad 15. These are disposed at the base 11.

The reference point 13 is a point of reference used when the underwater vehicle 30 is coupled to the underwater station 10. The underwater station 10 includes a communicator 16, and the communicator 16 is arranged on the reference point 13. The communicator 16 of the present embodiment includes a light emitter 17 and a light receiver 18. The light emitter 17 emits light, and the light emitted from the light emitter 17 is received by a light receiver 38 of the below-described underwater vehicle 30. Moreover, the light receiver 18 receives light emitted from a light emitter 39 of a below-described detector 32.

The first fitting 14 is a portion that is fitted to a second fitting 33 of the below-described underwater vehicle 30. The first fitting 14 is located around the reference point 13 as a center. The first fitting 14 is an annular groove 19 located around the reference point 13 as a center. As shown in FIG. 2, the annular groove 19 includes: an inner periphery inclined wall 20 located at an entrance side (near side when viewed from the underwater vehicle 30 that performs docking) and an inner side in a radial direction; and an outer periphery inclined wall 21 located at the entrance side and an outer side in the radial direction. The inner periphery inclined wall 20 is inclined such that a radius of the inner periphery inclined wall 20 increases as the inner periphery inclined wall 20 extends toward a deep side (deep side when viewed from the underwater vehicle 30 that performs the docking). The outer periphery inclined wall 21 is inclined such that a radius of the outer periphery inclined wall 21 decreases as the outer periphery inclined wall 21 extends toward the deep side.

The annular groove 19 further includes: a narrow portion 22 that is continuous with the inner periphery inclined wall 20 and the outer periphery inclined wall 21 and extends toward the deep side; and an enlarged portion 23 located adjacent to the narrow portion 22 at the deep side of the narrow portion 22. In a plan view, the narrow portion 22 and the enlarged portion 23 overlap each other, and a radial width of the enlarged portion 23 is larger than a radial width of the narrow portion 22. In the present embodiment, the annular groove 19 does not penetrate the base 11. However, the annular groove 19 may penetrate the base 11. In this case, the enlarged portion 23 of the annular groove 19 may be omitted.

The power supply pad 15 is a device that wirelessly supplies electric power to a power receiving pad 34 of the below-described underwater vehicle 30. The power supply pad 15 includes therein a power transmission coil and supplies electric power to the power receiving pad 34 by utilizing electromagnetic induction. In FIG. 1, a portion shown by diagonal lines is the power supply pad 15 (the same is true in FIG. 7 and FIG. 8). The power supply pad 15 of the present embodiment is annular around the reference point 13 as a center. Moreover, the power supply pad 15 of the present embodiment is located between the reference point 13 and the annular groove 19. However, the power supply pad 15 may be located outside the annular groove 19 in the radial direction.

Underwater Vehicle

Figure 3:
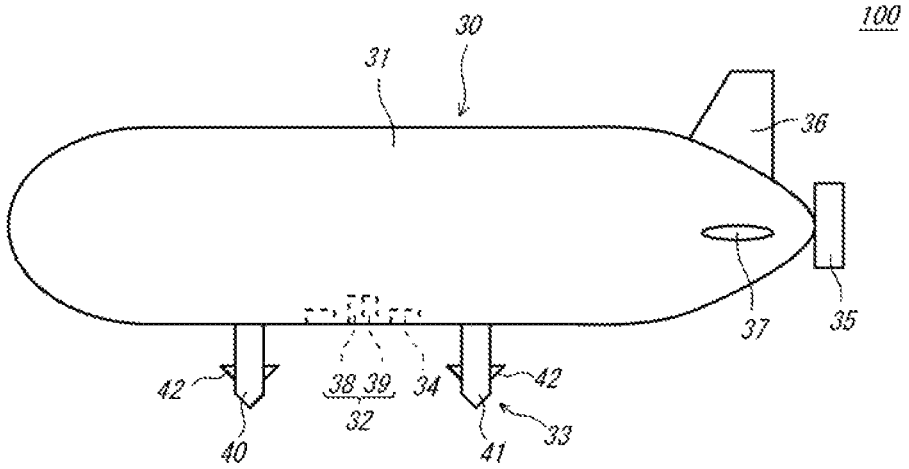
FIG. 3 is a side view of an underwater vehicle.
Figure 4:
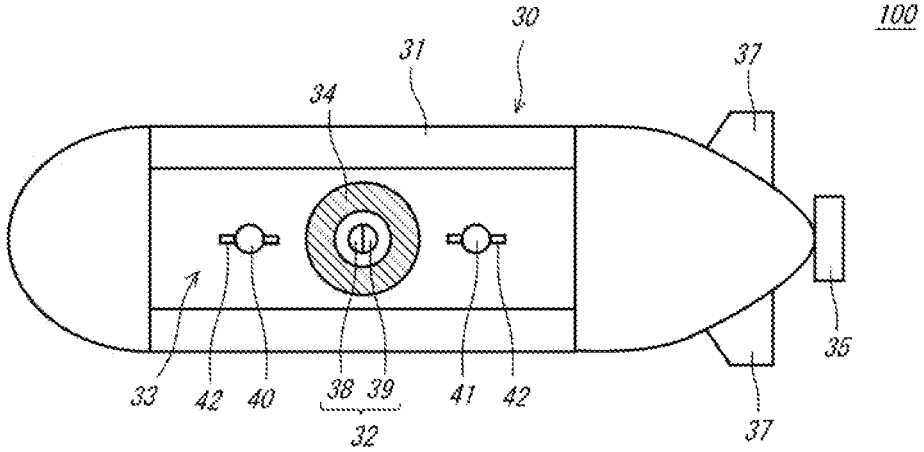
FIG. 4 is a bottom view of the underwater vehicle.

The underwater vehicle 30 is a device that sails in water and performs various types of work. The underwater vehicle 30 docks with the underwater station 10 when the underwater vehicle 30 is charged and exchanges data. FIG. 3 is a side view of the underwater vehicle 30, and FIG. 4 is a bottom view of the underwater vehicle 30. In each of FIG. 3 and FIG. 4, a paper surface left side of the underwater vehicle 30 is a nose side, and a paper surface right side of the underwater vehicle 30 is a tail side. To be specific, a paper surface left-right direction in each of FIG. 3 and FIG. 4 corresponds to a front-rear direction of the underwater vehicle 30. As shown in FIG. 3 and FIG. 4, the underwater vehicle 30 includes an airframe main body 31, the detector 32, the second fitting 33, and the power receiving pad 34.

A propulsion device 35, a vertical wing 36, a horizontal wing 37, and the like are disposed at the airframe main body 31. The propulsion device 35 generates thrust. The vertical wing 36 regulates posture in a horizontal direction. The horizontal wing 37 restricts posture in a vertical direction. Moreover, a controller, a storage battery, and the like are disposed inside the airframe main body 31. The controller controls the propulsion device 35 and the like. To reduce water resistance during sailing, the area of a section of the airframe main body 31 which section is perpendicular to the front-rear direction is small, and the airframe main body 31 has a shape that is long in the front-rear direction. Moreover, a bottom surface of the airframe main body 31 is flat.

The detector 32 is a device that detects the reference point 13 of the above-described underwater station 10. The detector 32 of the present embodiment includes the light receiver 38 and the light emitter 39. The light receiver 38 receives the light emitted from the light emitter 17 of the communicator 16 disposed on the reference point 13 of the underwater station 10. The detector 32 detects the reference point 13 based on the intensity of the light received by the light receiver 38. On the other hand, the light emitter 39 emits light, and the light emitted from the light emitter 39 is received by the light receiver 18 of the underwater station 10.

The detector 32 of the present embodiment detects the reference point 13 (communicator 16) of the underwater station 10, and in addition, can transmit data to and receive data from (exchange data with) the communicator 16 through the light. To be specific, the underwater station 10 can transmit data to the underwater vehicle 30 by the light emitted from the light emitter 17 and can acquire data from the underwater vehicle 30 by the light received by the light receiver 18. Similarly, the underwater vehicle 30 can transmit data to the underwater station 10 by the light emitted from the light emitter 39 and can acquire data from the underwater station 10 by the light received by the light receiver 38.

In the present embodiment, the detector 32 detects the reference point 13 by using the light. However, the detector 32 may detect the reference point 13 by using magnetism or sound. Moreover, the detector 32 may include a camera and detect the reference point 13 by using an image. In this case, the reference point 13 may be recognized by the image. For example, the reference point 13 may be marked, and the communicator 16 may be omitted.

The second fitting 33 is a portion that is fitted to the first fitting 14 of the underwater station 10. The second fitting 33 is located around the detector 32 as a center. The second fitting 33 of the present embodiment includes: a first protrusion 40 located at a front side of the detector 32; and a second protrusion 41 located at a rear side of the detector 32. A distance from the detector 32 to the first protrusion 40 is equal to a distance from the detector 32 to the second protrusion 41. The protrusions 40 and 41 are fitted to the annular groove 19 (first fitting 14) of the underwater station 10 by being inserted into the annular groove 19.

Each of the protrusions 40 and 41 extends downward from the airframe main body 31 and has a rod shape including a tapered tip portion. However, the shapes of the protrusions 40 and 41 are not limited. For example, each of the protrusions 40 and 41 has a plate shape extending downward from the airframe main body 31. Moreover, each of the protrusions 40 and 41 of the present embodiment is fixed to the airframe main body 31 but may be able to be accommodated inside the airframe main body 31 or may be foldable toward the airframe main body 31.

Figure 10:
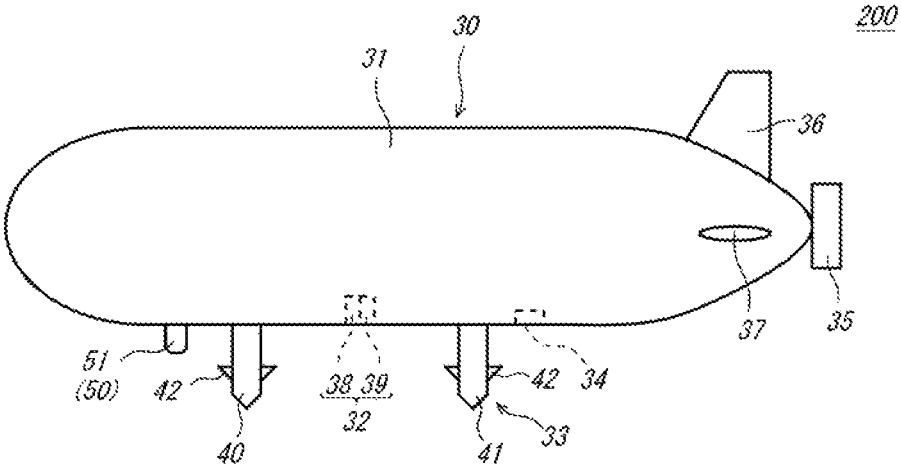
FIG. 10 is a side view of the underwater vehicle of Embodiment 2.

Moreover, each of the protrusions 40 and 41 includes locking portions 42. The locking portions 42 are portions that are locked to the annular groove 19 when the protrusions 40 and 41 are inserted into the annular groove 19 of the underwater station 10. The locking portions 42 of the present embodiment are disposed at two positions that are front and rear positions on a side surface of each of the protrusions 40 and 41. However, the number of locking portions 42 is not limited. Moreover, each locking portion 42 moves in the horizontal direction between an accommodated position at which the locking portion 42 is accommodated in each of the protrusions 40 and 41 and a projecting position at which the locking portion 42 projects from each of the protrusions 40. FIG. 10 shows that the locking portions 42 are located at the projecting positions. Each locking portion 42 is biased outward by a biasing member but can arbitrarily move between the accommodated position and the projecting position.

In the present embodiment, the locking portions 42 are disposed at both the first protrusion 40 and the second protrusion 41. However, the locking portions 42 may be disposed at only one of the first protrusion 40 and the second protrusion 41. Moreover, the locking portions 42 are disposed at two positions that are front and rear positions on the side surface of each of the protrusions 40 and 41. However, the locking portion 42 may be disposed at only one position.

The power receiving pad 34 is a device that is wirelessly supplied with electric power from the power supply pad 15 of the underwater station 10. The power receiving pad 34 includes therein a power reception coil and is supplied with electric power from the power supply pad 15 by utilizing electromagnetic induction. In FIG. 4, a portion shown by diagonal lines is the power receiving pad 34 (the same is true in FIG. 11). The power receiving pad 34 of the present embodiment is annular around the detector 32 as a center. A diameter of the power receiving pad 34 is equal to a diameter of the power supply pad 15. The power receiving pad 34 of the present embodiment is located between the detector 32 and each of the protrusions 40 and 41 but may be located outside the protrusions 40 and 41 in the radial direction.

Docking Method

Figure 5:
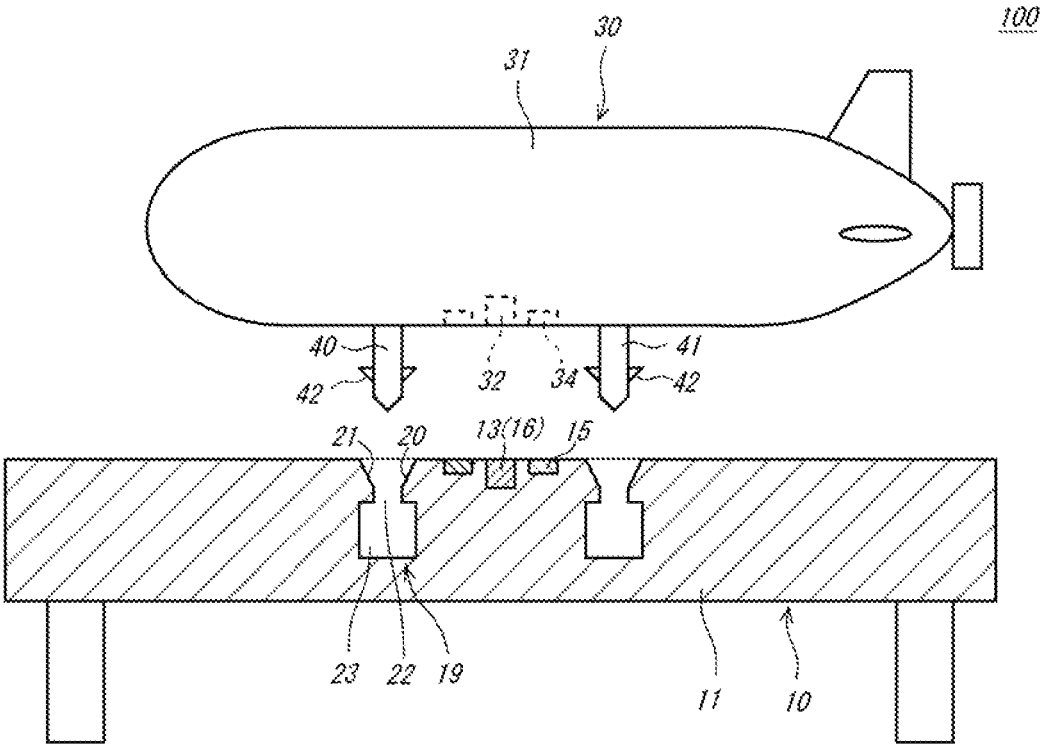
FIG. 5 is a diagram for explaining a docking method.
Figure 6:
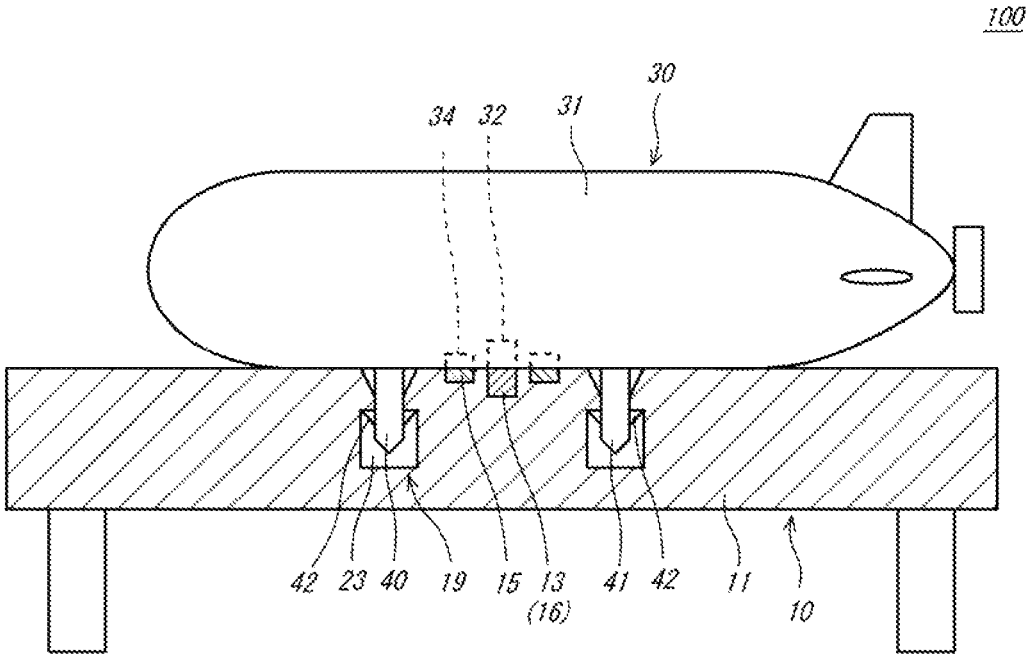
FIG. 6 is a diagram for explaining the docking method.
Figure 7:
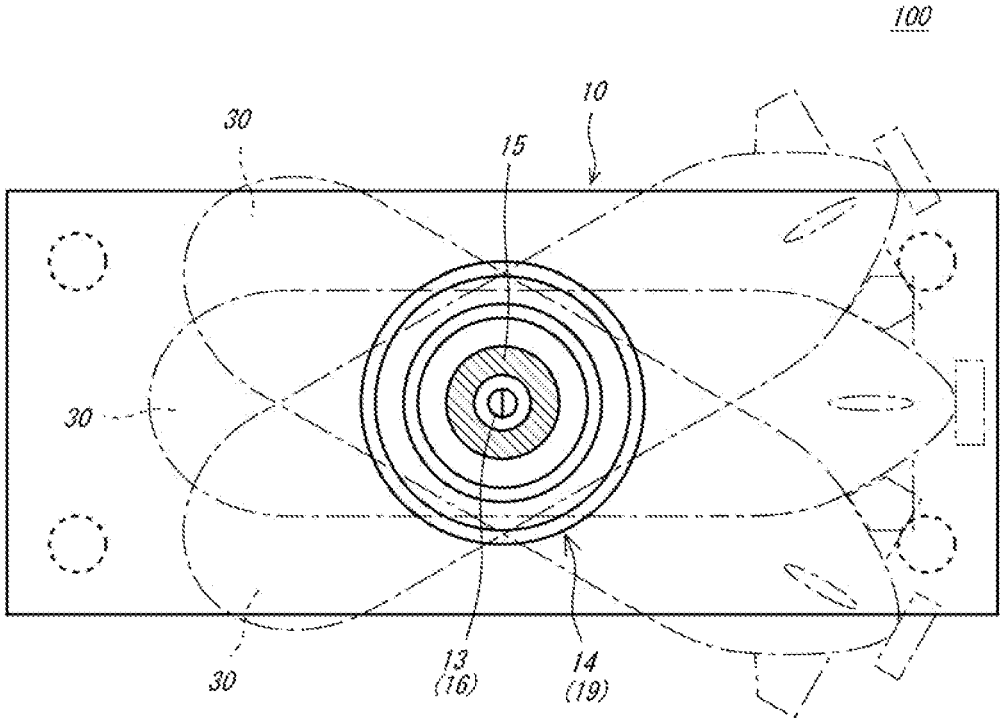
FIG. 7 is a plan view of an underwater docking system.

Next, a docking method of the underwater docking system 100 according to the present embodiment will be described. FIG. 5 and FIG. 6 are diagrams for explaining the docking method of the present embodiment. FIG. 7 is a plan view of the underwater docking system 100 in a docking state and is a diagram in which the underwater vehicles 30 directed in respective directions are show by one-dot chain lines.

The underwater vehicle 30 first performs preliminary positioning work when docking with the underwater station 10. The preliminary positioning work is work of making the positions of the reference point 13 and the detector 32 coincide with each other in the horizontal direction. Specifically, as shown in FIG. 5, the underwater vehicle 30 approaches the underwater station 10 and detects the reference point 13 of the underwater station 10 by using the detector 32. Then, the underwater vehicle 30 is moved such that the detector 32 is located right above the reference point 13.

After the preliminary positioning work is terminated, coupling work is then performed. The coupling work is work of fitting the first fitting 14 and the second fitting 33 to each other, i.e., work of inserting the protrusions 40 and 41 into the annular groove 19. Specifically, as shown in FIG. 6, by lowering the underwater vehicle 30 toward the underwater station 10, the protrusions 40 and 41 are inserted into the annular groove 19. During the above-described preliminary positioning work, the underwater vehicle 30 keeps on receiving the force of tidal current. Therefore, it is difficult to make the positions of the reference point 13 and the detector 32 strictly coincide with each other in the horizontal direction. On this account, by performing the coupling work including the contact, the positions of the reference point 13 and the detector 32 completely coincide with each other in the horizontal direction, and the underwater vehicle 30 is coupled to the underwater station 10. Thus, the docking is completed.

When inserting the protrusions 40 and 41 into the annular groove 19, each locking portion 42 is pushed by a wall surface of the narrow portion 22 to move to the accommodated position (i.e., to contract). Then, each locking portion 42 moves to the projecting position (i.e., spreads) at the enlarged portion 23 located beyond the narrow portion 22. With this, the locking portions 42 are locked to the annular groove 19, and this restricts the movement of the underwater vehicle 30 in an upper-lower direction. Moreover, when the underwater vehicle 30 separates from the underwater station 10, each locking portion 42 is moved to the accommodated position.

As shown in FIG. 6, when the underwater vehicle 30 has docked with the underwater station 10, the positions of the power receiving pad 34 of the underwater vehicle 30 and the power supply pad 15 of the underwater station 10 coincide with each other in the horizontal direction, and the positions of the detector 32 of the underwater vehicle 30 and the communicator 16 of the underwater station 10 coincide with each other in the horizontal direction. With this, the underwater vehicle 30 can be charged through the power supply pad 15 and the power receiving pad 34 and can exchange data with the underwater station 10 through the detector 32 and the communicator 16.

In addition, as shown in FIG. 7, since the first fitting 14 of the underwater station 10 is the annular groove 19, the underwater vehicle 30 can dock with the underwater station 10 regardless of the direction of the underwater vehicle 30. Therefore, for example, by performing the docking (especially, the preliminary positioning work) in a state where the underwater vehicle 30 is maintained such that the front-rear direction of the underwater vehicle 30 is parallel to the direction of the tidal current, the docking can be stably performed.

Modified Examples

In the above-described embodiment, the underwater station 10 includes the reference point 13, and the underwater vehicle 30 includes the detector 32. However, in contrast, the underwater vehicle 30 may include the reference point 13, and the underwater station 10 may include the detector 32. Even in this case, by supplying detection information of the reference point 13 from the underwater station 10 to the underwater vehicle 30, the preliminary positioning work of making the positions of the detector 32 and the reference point 13 coincide with each other in the horizontal direction can be performed.

Moreover, in the above-described embodiment, the underwater station 10 includes the annular groove 19, and the underwater vehicle 30 includes the protrusions 40 and 41. However, the underwater vehicle 30 may include the annular groove 19, and the underwater station 10 may include the protrusions 40 and 41. Even in this case, the coupling work can be performed by inserting the protrusions 40 and 41 into the annular groove 19.

Moreover, in the above-described embodiment, the second fitting 33 includes two protrusions 40 and 41. However, the second fitting 33 may include three or more protrusions. Furthermore, in the above-described embodiment, the locking portions 42 of the protrusions 40 and 41 are locked to the annular groove 19. However, the locking portions 42 may be locked to a peripheral portion of the annular groove 19. For example, if the annular groove 19 penetrates the base 11, the locking portions 42 may be locked to a back surface portion of the base 11.

Moreover, at the time of the docking in the present embodiment, the underwater vehicle 30 is located at an upper side of the underwater station 10 and approaches the underwater station 10 from the upper side. However, for example, when the underwater station 10 is located near the water surface, the underwater vehicle 30 may be located at a lower side of the underwater station 10 and approach the underwater station 10 from the lower side. In this case, the reference point 13, the first fitting 14, the power supply pad 15, and the like may be disposed at a "lower surface side" of the base 11 of the underwater station 10, and the detector 32, the second fitting 33, the power receiving pad 34, and the like may be disposed at an "upper surface" of the underwater vehicle 30.

Embodiment 2

Figure 8:
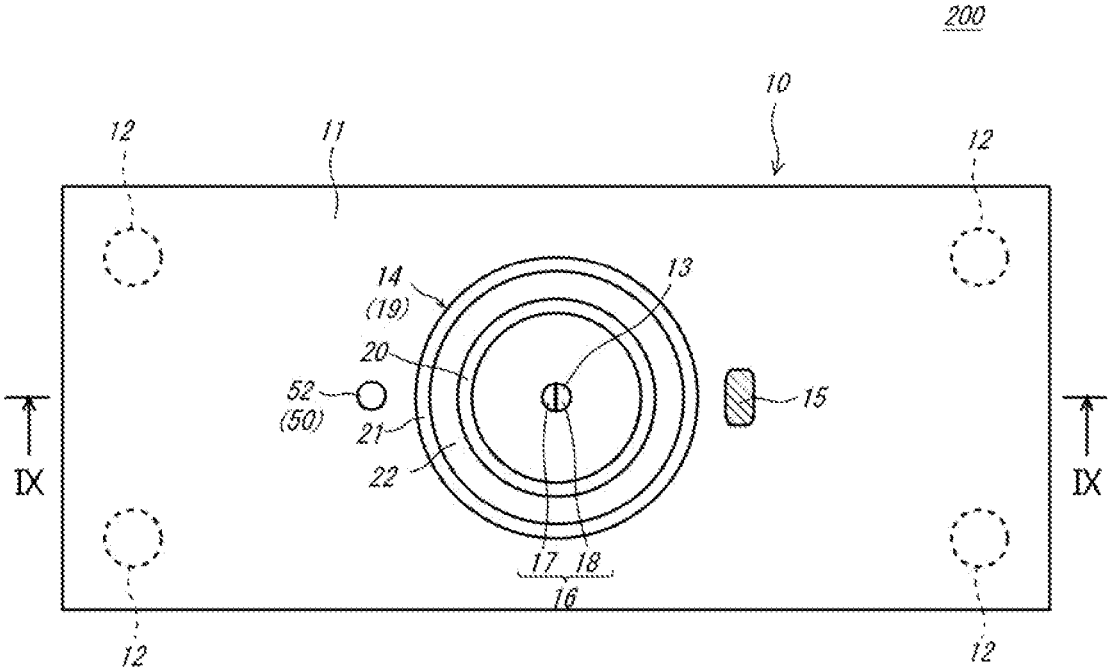
FIG. 8 is a plan view of the underwater station of Embodiment 2.
Figure 9:
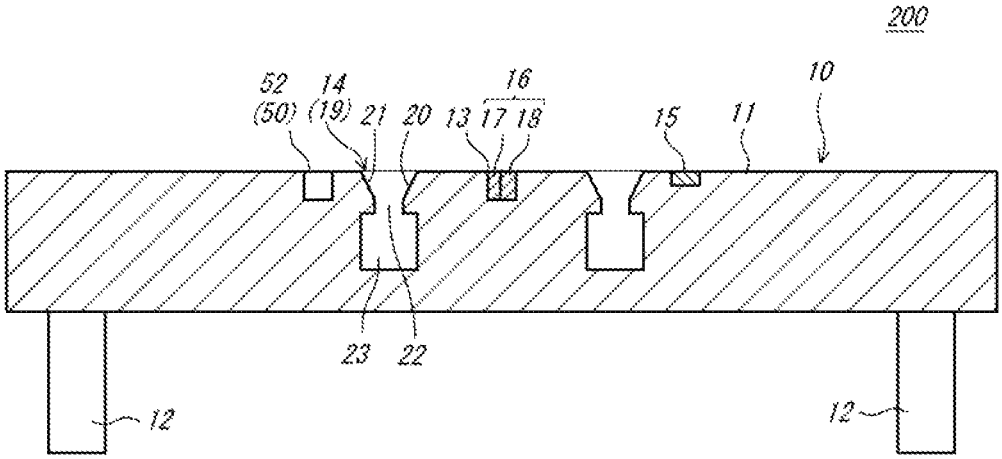
FIG. 9 is a sectional view taken along line IX-IX of FIG. 8.

Next, an underwater docking system 200 according to Embodiment 2 will be described. FIG. 8 is a plan view of the underwater station 10 included in the underwater docking system 200 according to Embodiment 2, and FIG. 9 is a sectional view taken along line IX-IX of FIG. 8. Moreover, FIG. 10 is a side view of the underwater vehicle 30 included in the underwater docking system 200 according to Embodiment 2, and FIG. 11 is a bottom view of the underwater vehicle 30.

The underwater docking system 200 according to the present embodiment is different from the underwater docking system 100 according to Embodiment 1 regarding the shapes and arrangement positions of the power supply pad 15 and the power receiving pad 34. Moreover, the underwater docking system 200 according to the present embodiment includes an angle determiner 50. Other than these, the underwater docking system 200 according to the present embodiment is basically the same in configuration as the underwater docking system 100 according to Embodiment 1. Hereinafter, the power supply pad 15, the power receiving pad 34, and the angle determiner 50 in the present embodiment will be mainly described, and the repetition of the same explanation as Embodiment 1 is avoided.

As shown in FIG. 8, the power supply pad 15 of the present embodiment is arranged only at one direction position (rear position) when viewed from the reference point 13. The power supply pad 15 of Embodiment 1 is annular around the reference point 13 as a center, i.e., the power supply pad 15 of Embodiment 1 is arranged at all angular positions when viewed from the reference point 13. Moreover, the power supply pad 15 of the present embodiment has a substantially rectangular shape. However, the power supply pad 15 may have another shape, such as a circular shape. Furthermore, the power supply pad 15 of the present embodiment is located outside the annular groove 19 in the radial direction when viewed from the reference point 13. However, the power supply pad 15 may be located inside the annular groove 19 in the radial direction.

Figure 11:
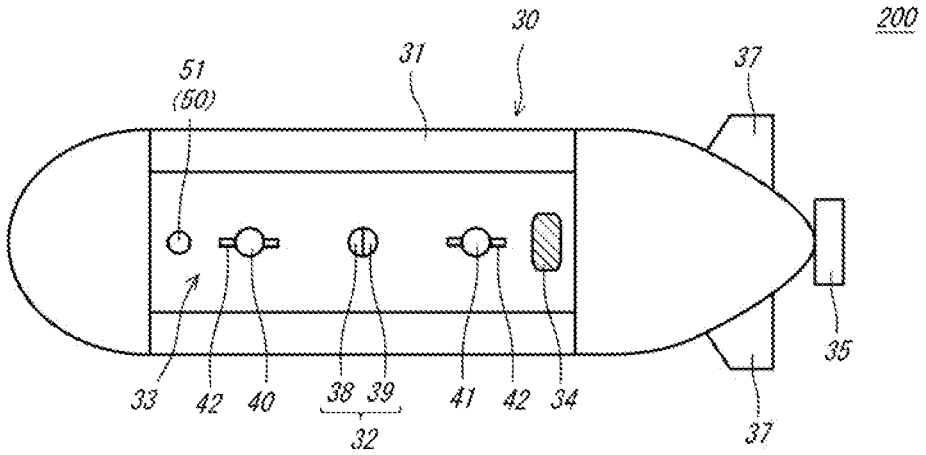
FIG. 11 is a bottom view of the underwater vehicle of Embodiment 2.

As shown in FIG. 11, the power receiving pad 34 of the present embodiment is arranged only at one direction position (rear position) when viewed from the detector 32. The power receiving pad 34 of Embodiment 1 is annular around the detector 32 as a center, i.e., the power receiving pad 34 of Embodiment 1 is arranged at all angular positions when viewed from the detector 32. Moreover, the power receiving pad 34 of the present embodiment has a substantially rectangular shape. However, the power receiving pad 34 may have another shape, such as a circular shape. Furthermore, the power receiving pad 34 of the present embodiment is located outside the second protrusion 41 in the radial direction when viewed from the detector 32. However, the power receiving pad 34 may be located inside the second protrusion 41 in the radial direction.

As shown in FIG. 8 to FIG. 11, the angle determiner 50 includes a positioning member 51 and a positioning hole 52. The positioning member 51 is disposed at the underwater vehicle 30 and extends downward from the airframe main body 31. Moreover, the positioning member 51 is located at a front side of the detector 32 and outside the first protrusion 40 in the radial direction. Furthermore, the positioning member 51 moves between an accommodated position at which the positioning member 51 is accommodated in the airframe main body 31 and a projecting position at which the positioning member 51 projects downward from the airframe main body 31. The positioning member 51 is biased downward and is normally located at the projecting position. When the positioning member 51 is pushed upward, the positioning member 51 moves to the accommodated position.

The positioning hole 52 is a hole in which the positioning member 51 is accommodated. The positioning hole 52 is located at the underwater station 10 and extends downward from the surface of the base 11. Moreover, the positioning hole 52 is located at an opposite side of the power supply pad 15 across the reference point 13 and is located outside the annular groove 19 in the radial direction. Furthermore, the positioning hole 52 is located at such a position that the positions of the power supply pad 15 and the power receiving pad 34 coincide with each other in the horizontal direction when the positions of the reference point 13 and the detector 32 coincide with each other in the horizontal direction, and the positioning hole 52 accommodates the positioning member 51.

At the time of the docking, the underwater docking system 200 configured as above performs the "preliminary positioning work" and the "coupling work" described in Embodiment 1 and then further performs "angular position determining work." The angular position determining work is work of making the positions of the power supply pad 15 and the power receiving pad 34 coincide with each other in the horizontal direction with the underwater vehicle 30 coupled to the underwater station 10 (see FIG. 6). At the time of the completion of the coupling work, the underwater vehicle 30 is rotatable about the detector 32 relative to the underwater station 10 in the horizontal direction.

In the angular position determining work, the underwater vehicle 30 is rotated about the detector 32 in the horizontal direction. This rotation may be performed by using the thrust generated from the propulsion device 35 of the underwater vehicle 30 or may be performed by the force received from the tidal current. When the positions of the positioning member 51 and the positioning hole 52 coincide with each other in the horizontal direction while the underwater vehicle 30 is rotating, the positioning member 51 enters into the positioning hole 52. With this, the positioning member 51 is locked to the positioning hole 52, and this restricts the rotation of the underwater vehicle 30. The position of the positioning hole 52 is the above-described position. Therefore, at this time (i.e., when the positioning member 51 enters into the positioning hole 52), the positions of the power supply pad 15 and the power receiving pad 34 coincide with each other in the horizontal direction. Thus, the docking is completed.

As above, the underwater docking system 200 according to the present embodiment requires the angular position determining work at the time of the docking. However, the power supply pad 15 and the power receiving pad 34 do not have to be annular, and the power supply pad 15 and the power receiving pad 34 can be simplified. Moreover, since the coupling work is completed before the angular position determining work, the underwater vehicle 30 does not become unstable by the direction of the tidal current during the angular position determining work. To be specific, according to the present embodiment, the docking can be stably performed.

The angle determiner 50 of the present embodiment includes the positioning member 51 and the positioning hole 52. However, the angle determiner 50 is not limited to this configuration. For example, as the angle determiner 50, a stopper may be disposed at the annular groove 19, and the stopper may be locked to the first protrusion 40 or the second protrusion 41 to restrict the rotation of the underwater vehicle 30.

Moreover, in the present embodiment, the power supply pad 15 is arranged only at one direction position when viewed from the reference point 13. However, the power supply pad 15 may be arranged at plural direction positions (for example, positions that are symmetric across the reference point 13) when viewed from the reference point 13. Similarly, the power receiving pad 34 of the present embodiment is arranged only at one direction position when viewed from the detector 32. However, the power receiving pad 34 may be arranged at plural direction positions when viewed from the detector 32.

Operational Advantages, Etc

Next, operational advantages, etc. of the underwater docking systems 100 and 200 will be described. Each of the underwater docking systems 100 and 200 includes: the underwater vehicle 30 that sails in water; and the underwater station 10 with which the underwater vehicle 30 docks. One of the underwater vehicle 30 and the underwater station 10 includes the reference point 13 and the first fitting 14 located around the reference point 13 as a center. The other of the underwater vehicle 30 and the underwater station 10 includes the detector 32 that detects the reference point 13 and the second fitting 33 located around the detector 32 as a center and fitted to the first fitting 14. One of the first fitting 14 and the second fitting 33 is the annular groove 19. The other of the first fitting 14 and the second fitting 33 includes at least two protrusions 40 and 41 that can be inserted into the annular groove 19.

According to this configuration, the docking can be performed even when the underwater vehicle 30 is directed in any direction. Regardless of the direction of the tidal current, the underwater vehicle 30 can stably dock with the underwater station 10.

In each of the underwater docking systems 100 and 200, the annular groove 19 includes the inner periphery inclined wall 20 located at an inner side in a radial direction and the outer periphery inclined wall 21 located at an outer side in the radial direction. The inner periphery inclined wall 20 is inclined such that a radius of the inner periphery inclined wall 20 increases as the inner periphery inclined wall 20 extends toward a deep side. The outer periphery inclined wall 21 is inclined such that a radius of the outer periphery inclined wall 21 decreases as the outer periphery inclined wall 21 extends toward the deep side.

According to this configuration, when the protrusions 40 and 41 contact the inner periphery inclined wall 20 or the outer periphery inclined wall 21, the protrusions 40 and 41 are guided to between the inner periphery inclined wall 20 and the outer periphery inclined wall 21. Therefore, even when the positions of the protrusions 40 and 41 and the annular groove 19 in the horizontal direction slightly deviate from each other in the preliminary positioning work, the protrusions 40 and 41 can be inserted into the annular groove 19, and therefore, the docking can be performed.

In each of the underwater docking systems 100 and 200, each of the at least two protrusions 40 and 41 has a rod shape including a tapered tip portion.

According to this configuration, by just inserting the tips of the protrusions 40 and 41 into the annular groove 19, the entire protrusions 40 and 41 can be inserted into the annular groove 19. On this account, even when the positions of the protrusions 40 and 41 and the annular groove 19 slightly deviate from each other in the preliminary positioning work, the protrusions 40 and 41 can be inserted into the annular groove 19, and therefore, the docking can be performed.

In each of the underwater docking systems 100 and 200, each of all or some of the at least two protrusions 40 and 41 includes the locking portion 42 that is locked to the annular groove 19 or the peripheral portion of the annular groove 19.

According to this configuration, the locking portion 42 is locked to the annular groove 19 or the peripheral portion of the annular groove 9. Therefore, once the protrusions 40 and 41 are inserted, the protrusions 40 and 41 are hardly pulled out, and the coupled state of the underwater vehicle 30 with the underwater station 10 can be maintained.

In each of the underwater docking systems 100 and 200, the underwater station 10 includes the reference point 13 and the first fitting 14, and the underwater vehicle 30 includes the detector 32 and the second fitting 33. The first fitting 14 includes the annular groove 19, and the second fitting 33 includes the at least two protrusions 40 and 41.

A dimension of the underwater vehicle 30 in the width direction is smaller than a dimension of the underwater vehicle 30 in the front-rear direction. When the underwater vehicle 30 includes the protrusions 40 and 41 as above, the protrusions 40 and 41 can be arranged so as to be lined up in the front-rear direction. Therefore, the underwater vehicle 30 can be prevented from increasing in size while suppressing the width thereof.

In each of the underwater docking systems 100 and 200, the at least two protrusions 40 and 41 include the first protrusion 40 and the second protrusion 41. The first protrusion 40 is located at a front side of the detector 32. The second protrusion 41 is located at a rear side of the detector 32. A distance from the detector 32 to the first protrusion 40 is equal to a distance from the detector 32 to the second protrusion 41.

According to this configuration, since the protrusions 40 and 41 and the detector 32 are linearly lined up, the components can be efficiently arranged at the underwater vehicle 30.

Moreover, in each of the underwater docking systems 100 and 200, the underwater station 10 includes the light emitter 17 that is located at the reference point 13 and emits light. The detector 32 includes the light receiver 38 that receives the light emitted from the light emitter 17. The detector 32 detects the reference point 13 based on intensity of the light received by the light receiver 38.

According to this configuration, the detector 32 can accurately detect the reference point 13.

In each of the underwater docking systems 100 and 200, the detector 32 includes the light emitter 39 that emits light. The underwater station 10 includes the communicator 16. The communicator 16 includes: the light emitter 17 located at the reference point 13; and the light receiver 18 that is located at the reference point 13 and receives the light emitted from the light emitter 39 of the detector 32. The detector 32 and the communicator 16 communicate with each other through the light.

According to this configuration, the underwater station 10 and the underwater vehicle 30 can communicate with each other by using the detector 32 and the communicator 16. Therefore, each of the underwater station 10 and the underwater vehicle 30 does not have to additionally include a communication device. On this account, regarding data exchange between the underwater station 10 and the underwater vehicle 30, the configurations of the underwater station 10 and the underwater vehicle 30 can be simplified.

In the underwater docking system 100, the underwater station 10 includes the power supply pad 15. The underwater vehicle 30 includes the power receiving pad 34 that is located at a position corresponding to the power supply pad 15 and is wirelessly supplied with electric power from the power supply pad 15. At least one of the power supply pad 15 and the power receiving pad 34 is annular around the reference point 13 or the detector 32 as a center.

According to this configuration, the underwater vehicle 30 can be charged even when the underwater vehicle 30 is directed in any direction. Therefore, the positioning of the underwater vehicle 30 in the horizontal direction (for example, the angular position determining work in Embodiment 2) does not have to be performed after the underwater vehicle 30 is coupled to the underwater station 10.

Moreover, in the underwater docking system 200, the underwater station 10 includes the power supply pad 15 located at a predetermined angular position when viewed from the reference point 13. The underwater vehicle 30 includes the power receiving pad 34 located at a predetermined angular position when viewed from the detector 32. With the at least two protrusions 40 and 41 inserted into the annular groove 19, the underwater vehicle 30 is rotatable relative to the underwater station 10 in the horizontal direction. The underwater docking system 200 further includes the angle determiner 50 that restricts the rotation of the underwater vehicle 30 relative to the underwater station 10 when the power supply pad 15 and the power receiving pad 34 overlap each other.

According to this configuration, the charging can be performed by performing positioning work (for example, the angular position determining work in Embodiment 2) of making the positions of the power supply pad 15 and the power receiving pad 34 coincide with each other. Therefore, the power supply pad 15 or the power receiving pad 34 do not have to be annular. Moreover, since the underwater docking system 200 includes the angle determiner 50, the positioning work can be easily performed.

From the foregoing description, numerous modifications and other embodiments of the present disclosure are obvious to those skilled in the art. Accordingly, the foregoing description is to be construed as illustrative only, and is provided for the purpose of teaching those skilled in the art the best mode for carrying out the present disclosure. The structural and/or functional details may be substantially modified without departing from the scope of the present disclosure.

What is claimed is:

1. An underwater docking system comprising:
an underwater vehicle that sails in water; and
an underwater station with which the underwater vehicle docks, wherein:
one of the underwater vehicle and the underwater station includes
a reference point and
a first fitting located around the reference point as a center;
the other of the underwater vehicle and the underwater station includes
a detector that detects the reference point and
a second fitting located around the detector as a center and fitted to the first fitting;
one of the first fitting and the second fitting is an annular groove; and
the other of the first fitting and the second fitting comprises at least two protrusions that are inserted into the annular groove.

2. The underwater docking system according to claim 1, wherein:
the annular groove includes
an inner periphery inclined wall located at an inner side in a radial direction and
an outer periphery inclined wall located at an outer side in the radial direction;
the inner periphery inclined wall is inclined such that a radius of the inner periphery inclined wall increases as the inner periphery inclined wall extends toward a deep side; and
the outer periphery inclined wall is inclined such that a radius of the outer periphery inclined wall decreases as the outer periphery inclined wall extends toward the deep side.

3. The underwater docking system according to claim 1, wherein each of the at least two protrusions has a rod shape including a tapered tip portion.

4. The underwater docking system according to claim 1, wherein each of all or some of the at least two protrusions includes a locking portion that is locked to the annular groove or a peripheral portion of the annular groove.

5. The underwater docking system according to claim 1, wherein:
the underwater station includes the reference point and the first fitting;
the underwater vehicle includes the detector and the second fitting;
the first fitting includes the annular groove; and
the second fitting includes the at least two protrusions.

6. The underwater docking system according to claim 5, wherein:
the at least two protrusions comprise a first protrusion and a second protrusion;
the first protrusion is located at a front side of the detector;
the second protrusion is located at a rear side of the detector; and
a distance from the detector to the first protrusion is equal to a distance from the detector to the second protrusion.

7. The underwater docking system according to claim 5, wherein:
the underwater station includes a light emitter that is located at the reference point and emits light;
the detector includes a light receiver that receives the light emitted from the light emitter; and
the detector detects the reference point based on intensity of the light received by the light receiver.

8. The underwater docking system according to claim 7, wherein:
the detector includes a light emitter that emits light;
the underwater station includes a communicator;
the communicator includes a light emitter located at the reference point and a light receiver that is located at the reference point and receives the light emitted from the light emitter of the detector; and
the detector and the communicator communicate with each other through the light.

9. The underwater docking system according to claim 5, wherein:
the underwater station includes a power supply pad;
the underwater vehicle includes a power receiving pad that is located at a position corresponding to the power supply pad and is wirelessly supplied with electric power from the power supply pad; and
at least one of the power supply pad and the power receiving pad is annular around the reference point or the detector as a center.

10. The underwater docking system according to claim 5, wherein:
the underwater station includes a power supply pad located at a predetermined angular position when viewed from the reference point;

the underwater vehicle includes a power receiving pad located at a predetermined angular position when viewed from the detector; and with the at least two protrusions inserted into the annular groove, the underwater vehicle is rotatable relative to the underwater station in a horizontal direction, the underwater docking system further comprising an angle determiner that restricts the rotation of the underwater vehicle relative to the underwater station when the power supply pad and the power receiving pad overlap each other.

11. An underwater vehicle included in the underwater docking system according to claim 1.

12. An underwater station included in the underwater docking system according to claim 1.

* * * * *